US009207623B2

(12) United States Patent
Kamiyama

(10) Patent No.: US 9,207,623 B2
(45) Date of Patent: Dec. 8, 2015

(54) IMAGE FORMING APPARATUS INCLUDING A NEUTRALIZING UNIT FOR NEUTRALIZING ELECTRIC CHARGE ON AN IMAGE SUPPORTING BODY

(71) Applicant: KYOCERA Document Solutions Inc., Osaka (JP)

(72) Inventor: Yuji Kamiyama, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 13/683,766

(22) Filed: Nov. 21, 2012

(65) Prior Publication Data

US 2013/0136499 A1 May 30, 2013

(30) Foreign Application Priority Data

Nov. 25, 2011 (JP) ..... 2011-257631

(51) Int. Cl.
*G03G 21/00* (2006.01)
*G03G 21/08* (2006.01)

(52) U.S. Cl.
CPC ..... *G03G 21/0005* (2013.01); *G03G 21/08* (2013.01); *G03G 2215/0132* (2013.01)

(58) Field of Classification Search
USPC ..... 399/128
See application file for complete search history.

(56) References Cited

U.S. PATENT DOCUMENTS 5,202,950 A * 4/1993 Arego et al. ..... 385/146
7,267,467 B2 * 9/2007 Wu et al. ..... 362/555
7,498,559 B2 * 3/2009 Nishimura et al. ..... 250/216
7,894,749 B2 2/2011 Jung
2003/0210557 A1 * 11/2003 Wu et al. ..... 362/555
2004/0071436 A1 4/2004 Kwon (Continued)

FOREIGN PATENT DOCUMENTS

JP 62179705 U * 11/1987 ..... G02B 6/00
JP 62179705 U * 11/1987 ..... G02B 6/00

(Continued)

OTHER PUBLICATIONS

Takano, Image Forming Device, JP 62179705U—English translation of JP 62179705 U.*

(Continued)

*Primary Examiner* — Billy Lactaoen
*Assistant Examiner* — Arlene Heredia Ocasio
(74) *Attorney, Agent, or Firm* — Pearl Cohen Zedek Latzer Baratz LLP

(57) ABSTRACT

The neutralization units 12*a* and 12*b* are arranged between the primary transfer positions and the cleaning units 11*a* and 11*b*, and, irradiate a region on the image supporting body 2*a* with first neutralization light 131, the regions spanning from a position facing the primary transfer position to a position facing the cleaning unit 11*a*. The neutralization units 12*a* and 12*b* irradiate a region on the image supporting body 2*b* with second neutralization light 132, the region spanning from a position facing the developing unit 16*b* to a position facing the primary transfer position. The neutralization units 12*a* and 12*b* include a first reflective part and a second reflective part provided at different positions on a side face of the light guiding body. The first reflective part forms the light 131 and the second reflective part forms the light 132 by reflecting the light from the neutralization light source.

10 Claims, 7 Drawing Sheets

(56) References Cited

U.S. PATENT DOCUMENTS

| | | | | |
|---|---|---|---|---|
| 2007/0189033 | A1* | 8/2007 | Watanabe et al. | 362/606 |
| 2007/0297189 | A1* | 12/2007 | Wu et al. | 362/555 |
| 2008/0130314 | A1* | 6/2008 | Liu et al. | 362/616 |
| 2009/0073720 | A1* | 3/2009 | Feng et al. | 362/616 |
| 2010/0002461 | A1* | 1/2010 | Wu et al. | 362/558 |
| 2011/0249987 | A1* | 10/2011 | Ishino et al. | 399/128 |

FOREIGN PATENT DOCUMENTS

| | | | | | |
|---|---|---|---|---|---|
| JP | S62-179705 | U | | 11/1987 | |
| JP | H2-045573 | U | | 3/1990 | |
| JP | 2001005122 | A | * | 1/2001 | G03B 27/54 |
| JP | 2004-070364 | | | 3/2004 | |
| JP | 2011-221405 | | | 4/2011 | |

OTHER PUBLICATIONS

Tabata, JP 2001-005122, English (machine) translation.*

English translation of JP62179705 U.*

Office Action for Japanese Application No. 2011-257631 mailed Jul. 2, 2013.

* cited by examiner

IMAGE FORMING APPARATUS INCLUDING A NEUTRALIZING UNIT FOR NEUTRALIZING ELECTRIC CHARGE ON AN IMAGE SUPPORTING BODY

CROSS REFERENCE TO RELATED APPLICATIONS

This application is based on and claims the benefit of priority from Japanese Patent Application No. 2011-257631, filed on 25 Nov. 2011, the content of which is incorporated herein by reference.

BACKGROUND

The present disclosure relates to an image forming apparatus employing xerography, provided with a neutralizing unit that neutralizes electric charge on an image supporting body by irradiating the image supporting body with light.

RELATED ART

In an image forming apparatus employing xerography, a two-step transfer method is widely used. In the two-step transfer method, an electrostatic latent image is formed on a surface of a photoreceptor drum as an image supporting body by electrically charging the surface of the photoreceptor drum and then exposing the surface of the photoreceptor drum thus charged; a toner image is formed by developing the electrostatic latent image by a toner; the toner image is primarily transferred to an intermediate transfer belt; and the toner image thus transferred to the intermediate transfer belt is secondarily transferred to paper as a transfer object.

For example, in a tandem-type image forming apparatus, a circular transfer belt is used as the intermediate transfer belt. The transfer belt is stretched around a driving roller and a driven roller, and rotates in a predetermined direction. Photoreceptor drums (image supporting bodies) of each color (magenta (M), cyan (C), yellow (Y) and black (Bk)) are arranged at intervals in a rotational direction of the circular intermediate transfer belt to face a primary transfer roller across the intermediate transfer belt. In the tandem-type image forming apparatus, an electrostatic latent image is formed on a peripheral surface of each photoreceptor drum by an exposing apparatus, and the electrostatic latent image is developed by the developing apparatus. The image forming apparatus transfers the toner images formed on the photoreceptor drums to the intermediate transfer belt to overlap with each other, and transfers the toner image on the intermediate transfer belt onto a sheet of paper being conveyed, to thereby form (print) an image.

Such an image forming apparatus has a problem of a transfer memory image and an exposure memory image being generated on the surface of the photoreceptor drum. The transfer memory image is generated in the following situation. The transfer current from the paper to the photoreceptor drum is different between a printed part and an unprinted part; a current value is lower in the printed part due to presence of the toner; and the surface potential thereof is higher than the peripheral potential corresponding to the unprinted part by several volts to several dozen volts, upon second electrical charging. When a transfer memory image is generated, a part in which the memory image is generated is printed lighter than a periphery in a background part.

In addition, an exposure memory image is generated due to a difference in surface potential, being lower than the peripheral potential by several volts to several dozen volts, upon follow-up exposure of an exposed part. When an exposure memory image is generated, a part in which the memory image is generated is printed darker than a periphery in a background part.

The difference in surface potential causing the transfer memory image and the exposure memory image depends on a configuration and the like of the apparatus.

In order to suppress the abovementioned transfer memory image and the exposure memory image, it is preferable that a region before the primary transfer and a region after the primary transfer on the photoreceptor drum are respectively irradiated with neutralization light, to neutralize electric charge on the surface of the photoreceptor drum.

For a neutralization unit provided in an image forming apparatus that irradiates a region before the primary transfer and a region after the primary transfer on a photoreceptor drum with neutralization light before and after the primary transfer, the following configuration is known. More specifically, the neutralization unit has a configuration in which: a substrate is arranged between a primary transfer position on a photoreceptor drum and a cleaning unit that cleans residual toner remaining on the photoreceptor drum; an LED chip is attached to one face of the substrate as a neutralization light source that irradiates a region on the photoreceptor drum after the primary transfer; and a through opening is formed at a position on the substrate at which the LED chip is attached through which a part of light emitted from the LED chip passes to another face of the substrate, to thereby irradiate the region before the primary transfer on an adjacent photoreceptor drum.

In the abovementioned image forming apparatus, it is required that a part of the light emitted from the LED chip passes through the through opening formed on the substrate. As a result, intensity of the neutralization light that is emitted to the region before the primary transfer on the adjacent photoreceptor drum is unstable and variable. Therefore, the intensity of the light passing through the through opening is difficult to adjust appropriately. This may lead to excessively intense neutralization light emitted to the region before the primary transfer, and, especially upon multiple transfer in a tandem-type image forming apparatus, a color toner on a downstream side may be scattered from the photoreceptor drum. In addition, depending on a shape and finishing of the through opening, the neutralization light for the region before the primary transfer may peak locally and may generate a slight vertical line on an image.

SUMMARY OF THE INVENTION

The present disclosure is an image forming apparatus comprising: a circular transfer belt that rotates in a predetermined direction; and a plurality of image forming units that is arranged at intervals in a rotational direction of the transfer belt. Each of the plurality of image forming units includes: an image supporting body that is arranged to face a primary transfer position on an outer face of the transfer belt and configured to be rotatable; a charging unit that electrically charges the image supporting body; an exposing unit that forms an electrostatic latent image on the image supporting body; a developing unit that develops the electrostatic latent image formed by the exposing unit with a toner to thereby form a toner image; a neutralizing unit that neutralizes electric charge on the image supporting body by irradiating the image supporting body with light; and a cleaning unit that cleans residual toner remaining on the image supporting body. In at least one of the plurality of image forming units, the neutralizing unit is arranged between the primary transfer position and the cleaning unit in a rotational direction of the image supporting body. The neutralizing unit irradiates a first neutralization light onto a region on the image supporting body constituting the image forming unit, the region spanning from a position facing the primary transfer position to a position facing the cleaning unit. The neutralizing unit irradiates a second neutralization light onto a region on the image supporting body constituting an image forming unit arranged adjacently to the image forming unit on a downstream side thereof in the rotational direction of the transfer belt, the region spanning from a position facing the developing unit to a position facing the primary transfer position. The neutralizing unit includes: an elongated light guiding body having a longitudinal direction and a shorter direction that is orthogonal to the longitudinal direction; a neutralization light source that guides light into the light guiding body in the longitudinal direction, from an end face thereof in the longitudinal direction; and a first reflective part and a second reflective part provided at different positions on a side face of the light guiding body in the shorter direction. The first reflective part forms the first neutralization light by reflecting the light from the neutralization light source to the shorter direction. The second reflective part forms the second neutralization light by reflecting the light from the neutralization light source to the shorter direction.

DETAILED DESCRIPTION OF THE INVENTION

First Embodiment

A first embodiment of the image forming apparatus according to the present disclosure will be described hereinafter with reference to the drawings. An overall structure of the printer 1 as a first embodiment of an image forming apparatus according to the present disclosure is described with reference to FIGS. 1 and 2.

Figure 1:
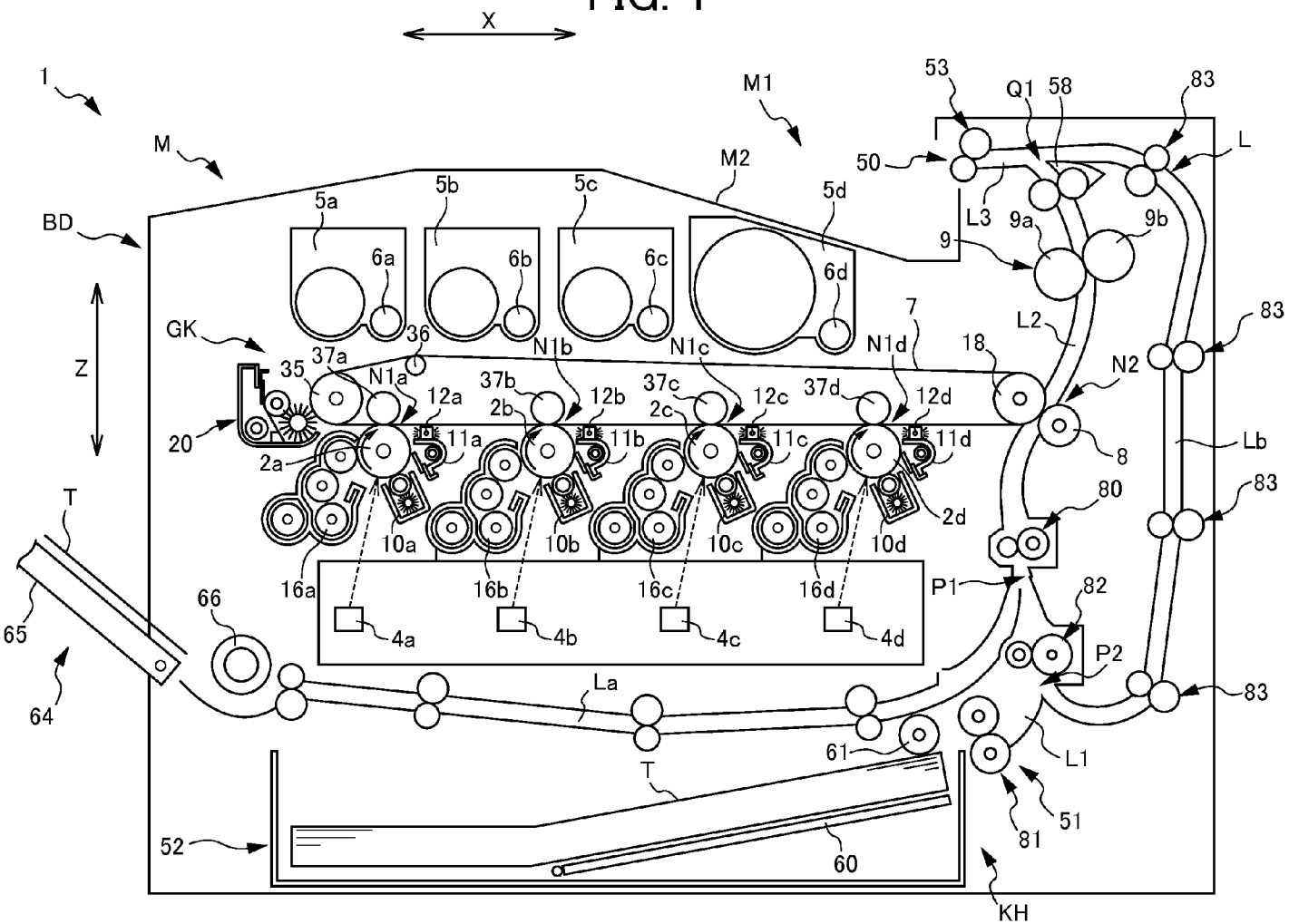
FIG. 1 is a diagram illustrating arrangement of components of a printer 1 according to a first embodiment of the present disclosure.

As shown in FIG. 1, the printer 1 as the image forming apparatus includes an apparatus main body M, an image forming portion GK, and a paper feeding/discharging unit KH. The image forming portion GK forms a predetermined toner image on paper T, as a sheet-shaped transfer material, based on predetermined image information. The paper feeding/discharging unit KH feeds the paper T to the image forming portion GK and ejects the paper T on which the toner image is formed. An external shape of the apparatus main body M is composed of a casing body BD as a housing.

Figure 2:
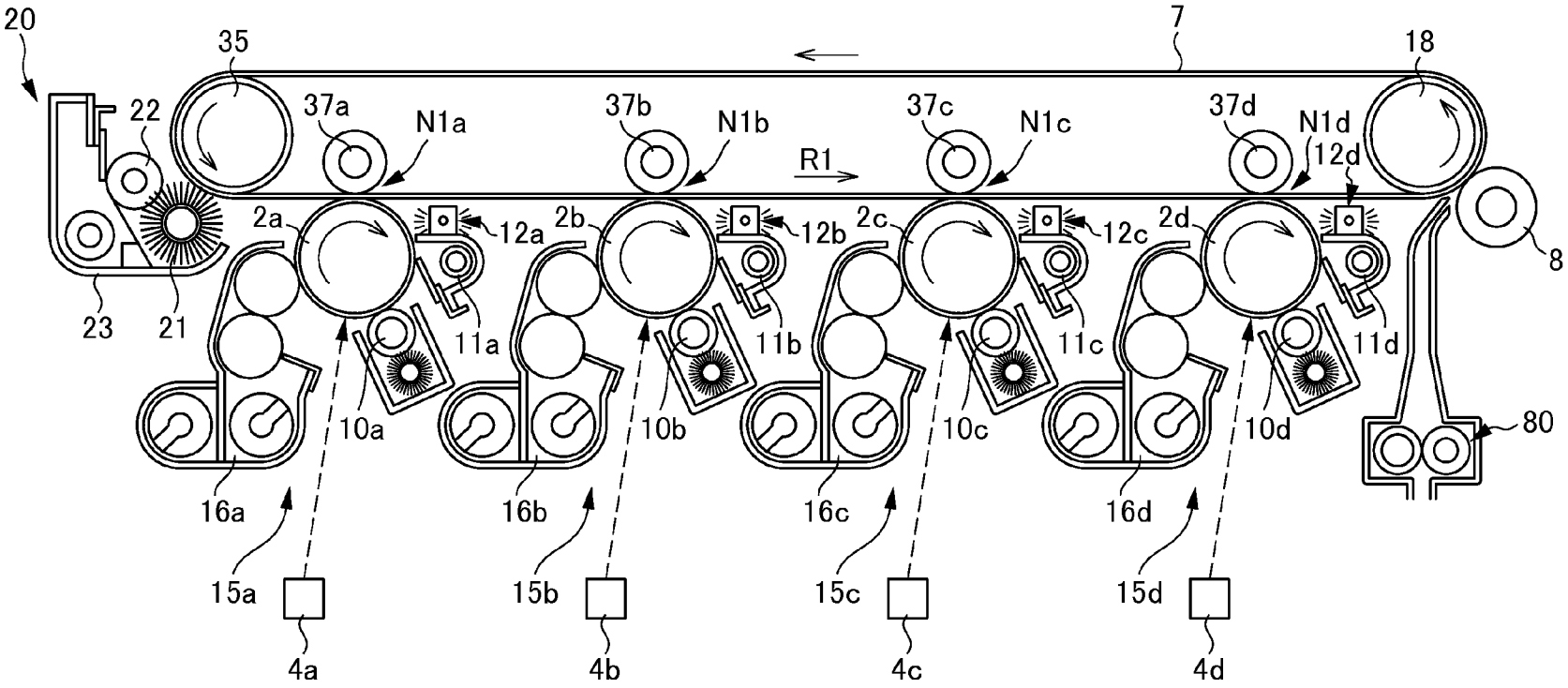
FIG. 2 is a vertical cross-sectional view illustrating a configuration of an image forming portion GK in the printer 1 according to the first embodiment.

As shown in FIGS. 1 and 2, the image forming portion GK includes: a circular intermediate transfer belt 7, which is an endless belt rotating in a predetermined direction indicated by an arrow in FIG. 2; four image forming units 15*a*, 15*b*, 15*c*, 15*d*; and a belt cleaning unit 20. The four image forming units 15*a*, 15*b*, 15*c*, 15*d* are aligned in the rotational direction R1 of the intermediate transfer belt 7 from an upstream side (left side in FIG. 1) to a downstream side (right side in FIG. 1) thereof, at intervals in the rotational direction R1 of the intermediate transfer belt 7.

The four image forming units 15*a*, 15*b*, 15*c*, 15*d* are: the image forming unit 15*a* for yellow, the image forming unit 15*b* for cyan, the image forming unit 15*c* for magenta, and the image forming unit 15*c* for black, in this order from the upstream side.

The belt cleaning unit 20 is disposed on an outer face of the intermediate transfer belt 7, to face the upstream side of the four image forming units 15*a*, 15*b*, 15*c*, 15*d* in the rotational direction R1 of the intermediate transfer belt 7. The belt cleaning unit 20 removes the residual toner remaining on the intermediate transfer belt 7. The belt cleaning unit 20 includes: a rotational brush 21 that rotates in contact with the intermediate transfer belt 7; a rotational roller 22 that sweeps away the residual toner scraped off by the rotational brush 21; and a residual toner container 23 that receives the residual toner thus swept.

The four image forming units 15*a*, 15*b*, 15*c*, 15*d* include: photoreceptor drums 2*a*, 2*b*, 2*c*, and 2*d* as image supporting bodies (photoreceptors); charging units 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding units 6*a*, 6*b*, 6*c*, and 6*d*; cleaning units 11*a*, 11*b*, 11*c*, and 11*d*; neutralization units 12*a*, 12*b*, 12*c*, and 12*d*; the intermediate transfer belt 7; and primary transfer rollers 37*a*, 37*b*, 37*c*, and 37*d*.

As shown in FIG. 1, the paper feeding/discharging unit KH includes a paper feeding cassette 52, a manual feeding portion 64, a paper path L for the paper T, a registration roller pair 80, a plurality of rollers or roller pairs, and an discharging part 50. It should be noted that, as described later, the paper feed path L is an assembly of a first paper feed path L1, a second paper feed path L2, a third paper feed path L3, a manual paper feed path La, and a reverse paper feed path Lb.

Configurations of the four image forming units 15*a*, 15*b*, 15*c*, 15*d* and the paper feeding/discharging unit KH of the image forming portion GK are described in detail hereinafter. First, the image forming units 15*a*, 15*b*, 15*c*, and 15*d* of the image forming portion GK are described.

In the image forming units 15*a*, 15*b*, 15*c*, and 15*d*, performed on a surface of the photoreceptor drums 2*a*, 2*b*, 2*c* and 2*d* are: charging by the charging portions 10*a*, 10*b*, 10*c* and 10*d*; exposure by the laser scanner units 4*a*, 4*b*, 4*c* and 4*d*; development by the developing units 16*a*, 16*b*, 16*c* and 16*d*; primary transfer by the intermediate transfer belt 7 and the primary transfer rollers 37*a*, 37*b*, 37*c* and 37*d*; static neutralization by the neutralization units 12*a*, 12*b*, 12*c* and 12*d*; and cleaning by the cleaning units 11*a*, 11*b*, 11*c* and 11*d*, from an upstream side to a downstream side. In addition, secondary transfer by the intermediate transfer belt 7, the secondary transfer roller 8 and the opposing roller 18, and fusion by the fusing unit 9 are performed.

Each of the photoreceptor drums 2*a*, 2*b*, 2*c*, and 2*d* is composed of a cylindrically shaped member and function as a photoreceptor or an image supporting body. The photoreceptor drums 2*a*, 2*b*, 2*c*, and 2*d* are disposed to face primary transfer positions (described later) on the side of the outer surface of the intermediate transfer belt 7 respectively, so as to be rotatable in a direction of an arrow, about an axis that extends in a direction orthogonal to a direction of movement of the intermediate transfer belt 7. An electrostatic latent image can be formed on a surface of each of the photoreceptor drums 2*a*, 2*b*, 2*c*, and 2*d*.

The charging portions 10*a*, 10*b*, 10*c*, and 10*d* are disposed so as to face a surface of the photoreceptor drums 2*a*, 2*b*, 2*c*, and 2*d*, respectively. The charging portions 10*a*, 10*b*, 10*c*, and 10*d* uniformly negatively charge (negative polarity) or positively charge (positive polarity) the surface of the photoreceptor drums 2*a*, 2*b*, 2*c*, and 2*d*, respectively.

The laser scanner units 4*a*, 4*b*, 4*c*, and 4*d*, which function as the exposure units, are disposed to be spaced apart from a surface of the photoreceptor drums 2*a*, 2*b*, 2*c*, and 2*d*, respectively. The laser scanner units 4*a*, 4*b*, 4*c*, and 4*d* include, respectively, a laser light source, a polygon mirror, a polygon mirror driving motor and the like, which are not illustrated.

The laser scanner units 4*a*, 4*b*, 4*c*, and 4*d* scan and expose the surface of the photoreceptor drums 2*a*, 2*b*, 2*c*, and 2*d* respectively, based on image information input from an external device such as a PC (personal computer). An electric charge of an exposed part of the surface of each of the photoreceptor drums 2*a*, 2*b*, 2*c*, and 2*d* is removed, which are scanned and exposed by the laser scanner units 4*a*, 4*b*, 4*c*, and 4*d*, respectively. In this way, an electrostatic latent image is formed on a surface of each of the photoreceptor drums 2*a*, 2*b*, 2*c*, and 2*d*.

The developing units 16*a*, 16*b*, 16*c*, and 16*d* are disposed to correspond to the photoreceptor drums 2*a*, 2*b*, 2*c*, and 2*d*, respectively, facing corresponding surfaces of the photoreceptor drums 2*a*, 2*b*, 2*c*, and 2*d*. The developing units 16*a*, 16*b*, 16*c*, and 16*d* each form a toner image of each color on the surface of the photoreceptor drums 2*a*, 2*b*, 2*c*, and 2*d* by depositing toner of each color on the electrostatic latent image formed on the surface of each of the photoreceptor drums 2*a*, 2*b*, 2*c*, and 2*d*. The developing units 16*a*, 16*b*, 16*c*, and 16*d* correspond to four colors: yellow, cyan, magenta, and black, respectively. The developing units 16*a*, 16*b*, 16*c*, and 16*d* include developing rollers that are disposed to face the surfaces of the photoreceptor drums 2*a*, 2*b*, 2*c*, and 2*d*, stirring rollers for stirring toners, respectively, and the like.

The toner cartridges 5*a*, 5*b*, 5*c*, and 5*d* are provided corresponding to the developing units 16*a*, 16*b*, 16*c*, and 16*d*, respectively, and store the toners of different colors that are supplied to the developing units 16*a*, 16*b*, 16*c*, and 16*d*, respectively. The toner cartridges 5*a*, 5*b*, 5*c*, and 5*d* store toners of yellow, cyan, magenta, and black respectively.

The toner feeding portions 6*a*, 6*b*, 6*c*, and 6*d* are provided correspondingly to the toner cartridges 5*a*, 5*b*, 5*c*, and 5*d* and the developing units 16*a*, 16*b*, 16*c*, and 16*d*, respectively. The toner feeding portions 6*a*, 6*b*, 6*c*, and 6*d* supply the toners of the colors stored in the toner cartridges 5*a*, 5*b*, 5*c*, and 5*d* to the developing units 16*a*, 16*b*, 16*c*, and 16*d*, respectively. The toner feeding portions 6*a*, 6*b*, 6*c*, and 6*d* are connected with the developing units 16*a*, 16*b*, 16*c*, and 16*d*, respectively, via toner feeding paths (not illustrated).

Toner images of respective colors formed on the photoreceptor drums 2*a*, 2*b*, 2*c*, and 2*d* are primarily transferred in sequence to the intermediate transfer belt 7. The intermediate transfer belt 7 is stretched around a driven roller 35, the opposing roller 18 consisting of a driving roller, a tension roller 36 (not illustrated in FIG. 2) and the like. As the tension roller 36 biases the intermediate transfer belt 7 from inside to outside, a predetermined tension is applied to the intermediate transfer belt 7.

Primary transfer rollers 37*a*, 37*b*, 37*c*, and 37*d* are arranged to face the photoreceptor drums 2*a*, 2*b*, 2*c*, and 2*d*, respectively, across the intermediate transfer belt 7.

Predetermined parts of the intermediate transfer belt 7 are sandwiched between the primary transfer rollers 37*a*, 37*b*, 37*c*, and 37*d* and the photoreceptor drums 2*a*, 2*b*, 2*c*, and 2*d*.

The sandwiched parts are pressed against surfaces of the photoreceptor drums 2*a*, 2*b*, 2*c*, and 2*d*. Primary transfer nips N1*a*, N1*b*, N1*c*, and N1*d* are thus formed between the photoreceptor drums 2*a*, 2*b*, 2*c*, and 2*d* and the primary transfer rollers 37*a*, 37*b*, 37*c*, and 37*d*, respectively. On each of the primary transfer nips N1*a*, N1*b*, N1*c*, and N1*d*, the toner images of the colors developed on the photoreceptor drums 2*a*, 2*b*, 2*c*, and 2*d* are primarily transferred sequentially to the intermediate transfer belt 7. In this manner, a full-color toner image is formed on the intermediate transfer belt 7.

A primary transfer bias is applied to each of the primary transfer rollers 37*a*, 37*b*, 37*c*, and 37*d* by a primary transfer bias application portion (not shown). The primary transfer bias is a bias for transferring the toner images of the colors formed respectively on the photoreceptor drums 2*a*, 2*b*, 2*c*, and 2*d* to the intermediate transfer belt 7.

The neutralization units 12*a*, 12*b*, 12*c*, and 12*d* are disposed to face surfaces of the photoreceptor drums 2*a*, 2*b*, 2*c*, and 2*d*, respectively. The neutralization units 12*a*, 12*b*, 12*c*, and 12*d* neutralize electricity (eliminate an electrical charge) of surfaces of the photoreceptor drums 2*a*, 2*b*, 2*c*, and 2*d*, respectively, after the primary transfer, by irradiating the surfaces of the photoreceptor drums 2*a*, 2*b*, 2*c*, and 2*d* with light. A specific configuration of the neutralization units 12*a*, 12*b*, 12*c*, and 12*d* is described later.

The cleaning units 11*a*, 11*b*, 11*c*, and 11*d* are disposed so as to face the surfaces of the photoreceptor drums 2*a*, 2*b*, 2*c*, and 2*d*, respectively. The cleaning units 11*a*, 11*b*, 11*c*, and 11*d* remove toner and attached matter remaining on the surfaces of the photoreceptor drums 2*a*, 2*b*, 2*c*, and 2*d*, respectively, and make the removed toner and the like carried to a predetermined collection mechanism for collection.

The secondary transfer roller 8 secondarily transfers the full-color toner image, which has been primarily transferred to the intermediate transfer belt 7, to the paper T. A secondary transfer bias is applied to the secondary transfer roller 8, by a secondary transfer bias application unit (not illustrated). The secondary transfer bias is a bias for transferring the full-color toner image formed on the intermediate transfer belt 7 to the paper T.

The secondary transfer roller 8 is brought into contact with, and spaced apart from, the intermediate transfer belt 7. More specifically, the secondary transfer roller 8 is configured to be movable between a contact position at which it is in contact with the intermediate transfer belt 7 and a spaced position at which it is spaced apart from the intermediate transfer belt 7. In particular, the secondary transfer roller 8 is disposed at the contact position for transferring the toner image primarily transferred to a surface of the intermediate transfer belt 7 to the paper T, and at the spaced position in all other circumstances.

The opposing roller 18 is disposed opposite to the secondary transfer roller 8 across the intermediate transfer belt 7. A predetermined part of the intermediate transfer belt 7 is sandwiched between the secondary transfer roller 8 and the opposing roller 18. The sheet of paper T is pressed against an outer surface (a surface to which the toner image is primarily transferred) of the intermediate transfer belt 7. A secondary transfer nip N2 is formed between the intermediate transfer belt 7 and the secondary transfer roller 8. On the secondary transfer nip N2, the full-color toner image primarily transferred to the intermediate transfer belt 7 is secondarily transferred to the paper T.

The fusing unit 9 fuses and pressurizes color toners composing the toner image secondarily transferred to the paper T, in order to fix the color toners on the paper T. The fusing unit 9 includes a heating rotator 9*a* that is heated by a heater, and a pressurizing rotator 9*b* that is brought into pressure-contact with the heating rotator 9*a*. The heating rotator 9*a* and the pressurizing rotator 9*b* sandwich and compress, and convey the paper T to which the toner image is secondarily transferred. The sheet of paper T is fed while sandwiched between the heating rotator 9*a* and the pressurizing rotator 9*b*, so that the toner transferred to the sheet of paper is fused and pressurized to be fixed to the sheet of paper T.

Next, the paper feeding/discharging unit KH is described.

As shown in FIG. 1, a paper feeding cassette 52 for storing the paper T is disposed in a lower portion of the apparatus main body M. The paper feeding cassette 52 is configured to be slidable in a horizontal direction from a housing of the apparatus main body M. The paper feeding cassette 52 includes a paper tray 60 on which the sheets of paper T are placed. The paper feeding cassette 52 stores the sheets of paper T stacked on paper Tray 60. A sheet of paper T placed on the sheet of paper Tray 60 is fed to the paper feed path L by a cassette feeding unit 51 disposed in an end part of the paper feeding cassette 52 on a side of feeding the sheet of paper (at a right end portion of FIG. 1). The cassette feeding unit 51 includes a double feed prevention mechanism consisting of: a forward feed roller 61 for picking up the paper T on the paper tray 60; and a paper feeding roller pair 81 for feeding the sheet of paper T one by one to the paper path L.

The manual feeding unit 64 is provided on a left lateral face (the left side in FIG. 1) of the apparatus main body M. The manual feeding portion 64 is provided primarily for the purpose of feeding paper T that is different in size and type from the paper T stored in the paper feeding cassette 52 to the apparatus main body M. The manual feeding portion 64 includes the manual feeding tray 65, which constitutes a portion of a left lateral face of the apparatus main body M in a closed state, and a paper feeding roller 66. A lower end of the manual feeding tray 65 is connected in the vicinity of the paper feeding roller 66, so as to be rotatable (openable and closable). A sheet or sheets of paper T are placed on the manual feeding tray 65 while it is open. The paper feeding roller 66 feeds a sheet of paper T placed on the manual feeding tray 65 while it is open to the manual feeding path La.

The paper feed path L includes: a first paper feed path L1 from the cassette feeding unit 51 to the secondary transfer nip N2; a second paper feed path L2 from the secondary transfer nip N2 to the fixing part 9; a third paper feed path L3 from the fixing part 9 to the discharging part 50; the manual paper feed path La that guides paper fed from the feeding unit 64 to the first paper feed path L1; and a reverse paper feed path Lb that reverses and returns the paper that is fed from a downstream side to an upstream side in the third paper feed path L3 to the first paper feed path L1.

The first paper path L1 feeds the paper T stored in the paper feeding cassette 52 toward the image forming portion GK. The manual paper feed path La feeds the paper T stored in the manual feeding portion 64 toward the registration roller pair 80 (described later).

In addition, a first junction P1 and a second junction P2 are provided in the middle of the first paper path L1. A first branch portion Q1 is provided in the middle of the third paper feed path L3. The first junction P1 is a junction where the manual paper feed path La joins the first paper feed path L1. The second junction P2 is a junction where the reverse paper path Lb joins the first paper path L1. The first branch portion Q1 is a branch portion where the reverse paper path Lb branches off from the third paper path L3.

A paper detection sensor (not illustrated) for detecting the paper T and a registration roller pair 80 are disposed in the middle of the first paper path L1 (more specifically, between the second junction P2 and the secondary transfer roller 8). The registration roller pair 80 is designed for skew compensation of the paper T and timing adjustment between formation of the toner image in the image forming portion GK and conveyance of the paper T. The paper detection sensor is disposed immediately before the registration roller pair 80 in a conveying direction of the paper T (on an upstream side thereof in the conveying direction). The registration roller pair 80 conveys the paper T while performing the above-mentioned compensation and the timing adjustment based on detection information from the paper detection sensor.

A first feeding roller pair 82 as a first roller is disposed between the first junction P1 and the second junction P2 in the first paper path L1. The first feeding roller pair 82 is disposed on the downstream side of the paper feeding roller pair 81. The first feeding roller pair 82 sandwiches and feeds the paper T, which is fed from the paper feeding roller pair 81, to the registration roller pair 80 as the second roller.

For a case of performing duplex printing of the paper T, a reverse paper path Lb is provided for making an opposite surface (an unprinted surface), to a surface that has already been printed, face toward the intermediate transfer belt 7. A plurality of second feeding roller pairs 83 that feed the paper T to the second junction P2 is disposed at predetermined intervals in the reverse paper path Lb. The reverse paper feed path Lb can reverse and return the paper T, fed from the first branch portion Q1 toward the discharging part 50, to the first paper feed path L1, in order to feed the paper T to an upstream side of the registration roller pair 80 disposed on an upstream side of the secondary transfer roller 8. At the secondary transfer nip N2, a predetermined toner image is transferred to the unprinted surface of the sheet of paper T that has been reversed by the return paper feed path Lb.

A regulating member 58 is provided in the first branch portion Q1. The regulating member 58 regulates a feed direction of the paper T, which is discharged from the fusing unit 9 and fed from the upstream side to the downstream side of the third paper feed path L3, to a direction toward the discharging part 50. In addition, the regulating member 58 shunts a conveying direction of the paper T, which is conveyed from discharging part 50 from the downstream side to the upstream side of the third paper path L3, to a direction toward the reverse paper path Lb.

The discharging part 50 is formed in an end portion of the third paper path L3. The discharging part 50 is disposed in an upper portion of the apparatus main body M. The ejecting part 50 has an opening toward a left lateral face of the apparatus main body M (left side in FIG. 1). The discharging part 50 ejects the paper T to the outside of the apparatus main body M. The discharging part 50 includes an discharging roller pair 53. The discharging roller pair 53 ejects the paper T, which is conveyed in the third paper path L3 from the upstream side to the downstream side, to the outside of the apparatus main body M. The discharging roller pair 53 feeds the paper T toward the upstream side of the third paper feed path L3 by reversing the feed direction of the paper T at the discharging part 50.

An ejected paper accumulating portion M1 is formed in the vicinity of the opening of the discharging part 50. The ejected paper accumulating portion M1 is formed on an upper face (outer face) of the apparatus main body M. The ejected paper accumulating portion M1 is a portion of the upper face of the apparatus main body M formed to be dented downward. The bottom face of the ejected paper accumulating portion M1 is composed of a top cover member M2 as an open/close member constituting a part of the upper face of the apparatus main body M. The paper T, on which a predetermined toner image is formed and which is ejected from the discharging part 50, is stacked and accumulated on the upper face of the top cover member M2 constituting the ejected paper accumulating portion M1. A sensor for detecting a sheet of paper is disposed at a predetermined position of each paper path.

Next, operation of the printer 1 according to the first embodiment is briefly described with reference to FIG. 1. First, single-side printing on the paper T stored in the paper feeding cassette 52 is described.

The paper T contained in the paper feeding cassette 52 is fed to the first paper feed path L1 by the forward feed roller 61 and the paper feeding roller pair 81, and then fed to the registration roller pair 80 by the first feeding roller pair 82 via the first junction P1 and the first paper feed path L1. The registration roller pair 80 performs skew compensation of the paper T and timing adjustment with respect to the toner image in the image forming portion GK.

The paper T discharged from the registration roller pair 80 is introduced into between the intermediate transfer belt 7 and the secondary transfer roller 8 (the secondary transfer nip N2) via the first paper path L1. A toner image is transferred to the paper T between the intermediate transfer belt 7 and the secondary transfer roller 8. Thereafter, the paper T is discharged from between the intermediate transfer belt 7 and the secondary transfer roller 8, and introduced into the fixing nip between the heating rotator 9*a* and the pressurizing rotator 9*b* in the fusing unit 9. Toner is then fused in the fixing nip and fixed onto the paper T.

Subsequently, the paper T is conveyed to the discharging part 50 via the third paper path L3 and ejected from the discharging part 50 to the ejected paper accumulating portion M1 by the discharging roller pair 53. Single-side printing on the paper T stored in the paper feeding cassette 52 is thus completed.

In a case of single-side printing on the paper T placed on the manual feeding tray 65, the paper T placed on the manual feeding tray 65 is dispatched to the manual paper path La by the paper feeding roller 66, and then conveyed to the registration roller pair 80 via the first junction P1 and the first paper path L1. Other operations are the same as in the case of single-side printing on the paper T stored in the paper feeding cassette 52, and therefore descriptions thereof are omitted.

Next, operation of the printer 1 performing duplex printing is described.

In a case of single-side printing, as described above, printing is completed by ejecting the paper T printed on one side from the paper discharging part 50 to the ejected paper accumulating portion M1. On the other hand, in a case of duplex printing, the paper T printed on one side is reversed and reconveyed to the registration roller pair 80 via the reverse paper path Lb to thereby perform printing on another side.

In more detail, the operation is the same as in the abovementioned single-side printing until before discharging of the paper T printed on one side from the paper discharging part 50 by the discharging roller pair 53. However, in a case of duplex printing, the discharging roller pair 53 stops rotating and rotates again in an opposite direction, in a state of holding the paper T printed on one side. By thus rotating the discharging roller pair 53 in an opposite direction, the paper T held by the discharging roller pair 53 is conveyed in an opposite direction in the third paper path L3 (a direction from the paper discharging part 50 to the first branch portion Q1).

As described above, when the paper T is conveyed in the opposite direction in the third paper path L3, the regulating member 58 directs the paper T to the reverse paper path Lb. And then the paper T enters into the first paper path L1 via the second junction P2. Here, the paper T is reversed from the orientation thereof in printing on the one side.

Furthermore, the registration roller pair 80 performs the abovementioned compensation or the abovementioned adjustment on the paper T, which is then introduced into the secondary transfer nip N2 via the first paper path L1. Since an unprinted surface of the paper T faces the intermediate transfer belt 7 as a result of passing through the reverse paper feed path Lb, a toner image is transferred to the unprinted surface and duplex printing is thus realized.

Next, a configuration of the neutralization units 12*a*, 12*b*, 12*c*, and 12*d* in the four image forming units 15*a*, 15*b*, 15*c*, and 15*d* of the printer 1 according to the first embodiment is described with reference to FIGS. 3 to 7.

Figure 3:
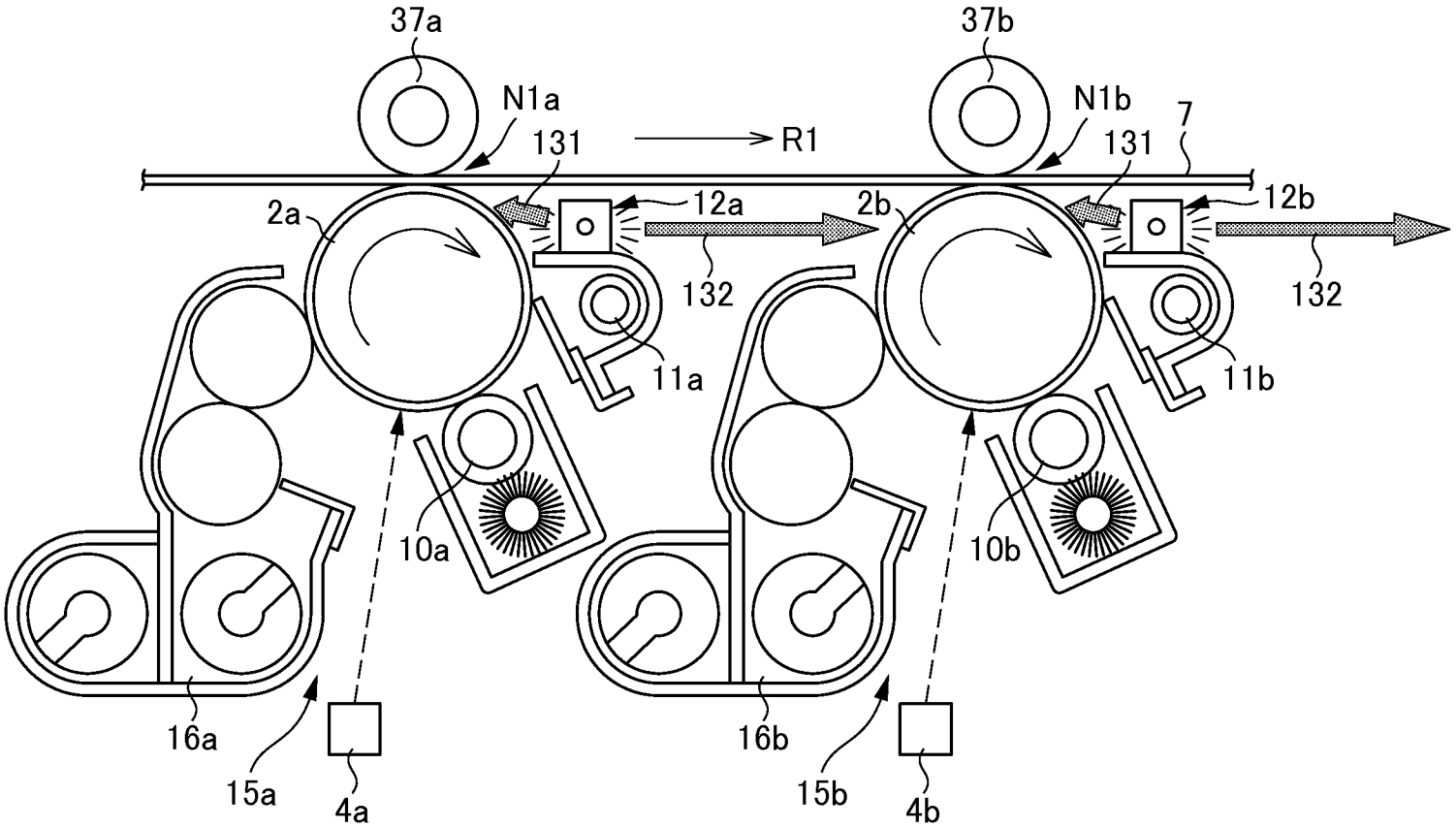
FIG. 3 is an enlarged vertical cross-sectional view illustrating a configuration of two image forming units 15*a*, 15*b* arranged on an upstream side in a rotational direction R1 of an intermediate transfer belt 7, among four image forming units 15*a*, 15*b*, 15*c*, and 15*d;*

As shown in FIGS. 2 and 3, in the four image forming units 15*a*, 15*b*, 15*c*, and 15*d*, the neutralization units 12*a*, 12*b*, 12*c*, and 12*d* are arranged between the primary transfer positions and the cleaning units 11*a*, 11*b*, 11*c*, and 11*d*, respectively. The primary transfer positions are positions at which the primary transfer nips N1*a*, N1*b*, N1*c*, and N1*d* are formed in the rotational direction of the photoreceptor drums 2*a*, 2*b*, 2*c*, and 2*d*.

The neutralization units 12*a*, 12*b*, 12*c*, and 12*d* irradiate regions on the photoreceptor drums 2*a*, 2*b*, 2*c* and 2*d* constituting the four image forming units 15*a*, 15*b*, 15*c*, and 15*d* with first neutralization light 131, the regions spanning from positions facing the primary transfer positions to positions facing the cleaning units 11*a*, 11*b*, 11*c*, and 11*d*, respectively. The neutralization units 12*a*, 12*b*, and 12*c* are configured to irradiate regions on the photoreceptor drums 2*b*, 2*c* and 2*d* constituting the three image forming units 15*b*, 15*c*, and 15*d* that are adjacent to the image forming units 15*a*, 15*b*, and 15*c* on the downstream side in the rotational direction R1 of the intermediate transfer belt 7 with second neutralization light 132, the regions spanning from positions facing the developing units 16*b*, 16*c*, and 16*d* to positions facing the primary transfer positions.

The photoreceptor drum 2*a*, which constitutes the image forming unit 15*a* arranged on the most upstream side in the rotational direction R1 of the intermediate transfer belt 7 among the four image forming units 15*a*, 15*b*, 15*c*, and 15*d*, is not irradiated with the second neutralization light 132.

Figure 4:
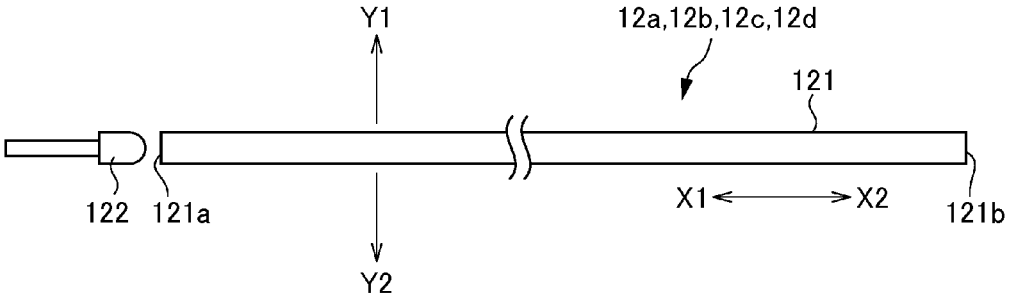
FIG. 4 is a front view illustrating a configuration of neutralization units 12*a*, 12*b*, 12*c*, and 12*d;*

As shown in FIG. 4, the neutralization units 12*a*, 12*b*, 12*c*, and 12*d* are provided respectively with an elongated light guiding body 121 and a neutralization light source 122.

The elongated light guiding body 121 has a longitudinal direction X1-X2 that is orthogonal to the rotational direction R1 of the intermediate transfer belt 7 and a shorter direction Y1-Y2 that is orthogonal to the longitudinal direction X1-X2. The neutralization light source 122 introduces light from a first end face 121*a* of the light guiding body 121 in the longitudinal direction X1-X2 to a second end face 121*b* in the longitudinal direction X1-X2. As the neutralization light source 122, an LED is used.

Figure 5:
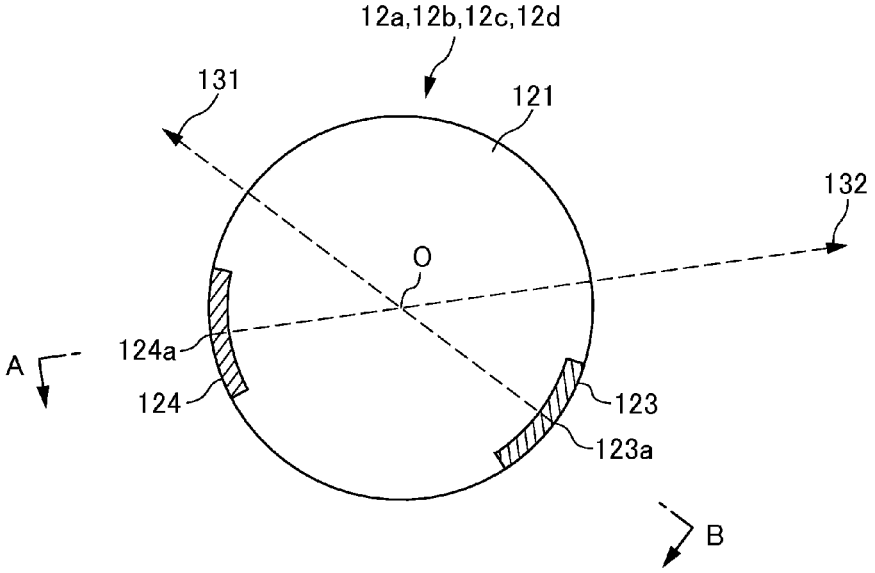
FIG. 5 is an enlarged vertical cross-sectional view of a light guiding body 121 constituting the neutralization units 12*a*, 12*b*, 12*c*, and 12*d* shown in FIG. 4.

As shown in FIG. 5, the elongated light guiding body 121 has a substantially cylindrical shape. A first reflective part 123 and a second reflective part 124, having predetermined respective widths in a peripheral direction, are formed on a side face of the cylindrical, elongated light guiding body 121 in the shorter direction Y1-Y2, in other words at different positions on an outer peripheral face of the light guiding body 121 in a peripheral direction.

The first reflective part 123 and the second reflective part 124 are formed along substantially the whole length of the elongated light guiding body 121 in the longitudinal direction X1-X2, at least along a width of a charged region. Central positions 123*a* and 124*a* of widths in the peripheral direction of the substantially cylindrical light guiding body 121 at the first reflective part 123 and the second reflective part 124, respectively, are in a positional relationship except for 180° in the peripheral direction of the light guiding body 121, for example from 120° to 150°.

The first reflective part 123 reflects the light emitted from the neutralization light source 122 to the shorter direction, in other words peripherally outward from a center O of the cylindrical light guiding body 121, thereby forming the first neutralization light 131. The second reflective part 124 reflects the light emitted from the neutralization light source 122 to the shorter direction, in other words peripherally outward, differently from the first neutralization light 131, from the center O of the cylindrical light guiding body 121, thereby forming the second neutralization light 132.

The positional relationship except for 180° as described above can realize a configuration in which the first neutralization light 131 is not incident upon the second reflective part 124 and the second neutralization light 132 is not incident upon the first reflective part 123.

Figure 6:
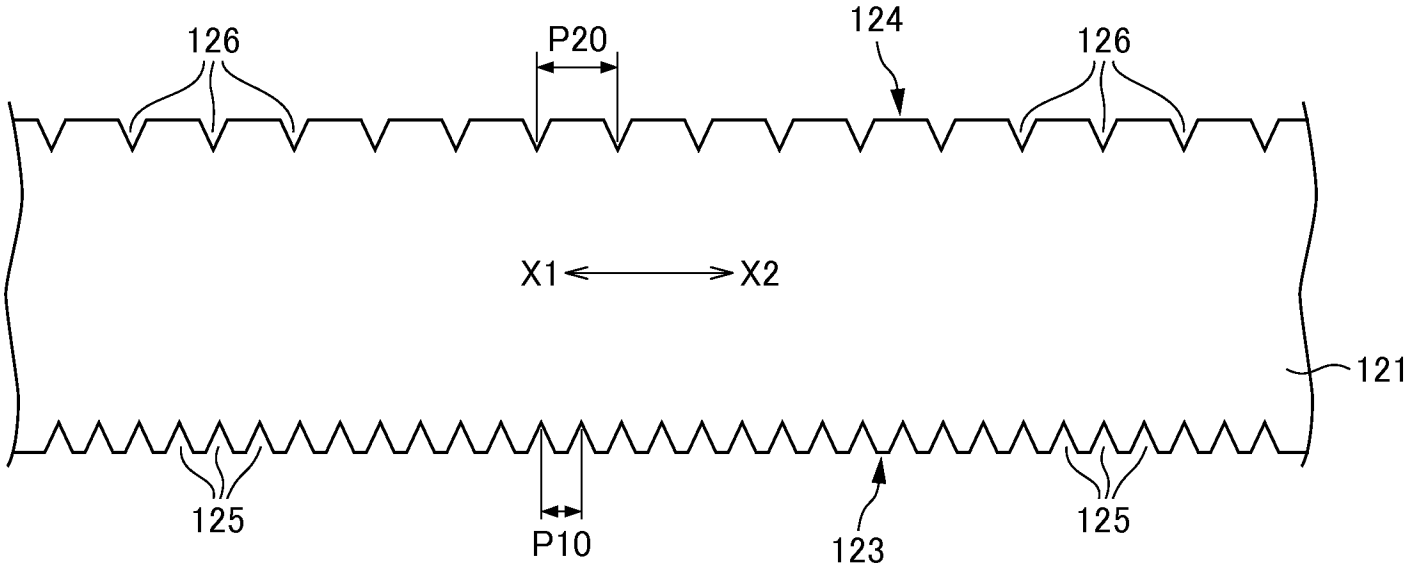
FIG. 6 is a cross-sectional view taken along a line A-O-B of FIG. 5.

As shown in FIG. 6, the first reflective part 123 and the second reflective part 124 in the light guiding body 121 are formed in serrated shapes. In the serrated shapes, a plurality of concave grooves 125 or a plurality of concave grooves 126 is aligned on the outer peripheral surface, which is a side face, of the light guiding body 121, uniformly in the longitudinal direction X1-X2 of the light guiding body 121. Pitch P10 of the plurality of concave grooves 125 on the serrated first reflective part 123 is set to be smaller than pitch P20 of the plurality of concave grooves 126 on the serrated second reflective part 124. The pitch P10 of the concave grooves 125 is, for example, two to three times of the pitch P20 of the concave grooves 126. As a result, the intensity of the first neutralization light 131 that is reflected by the first reflective part 123 becomes higher than the intensity of the second neutralization light 132 that is reflected by the second reflective part 124. The intensity of light is substantially proportional to the pitch of the concave grooves.

Figure 7:
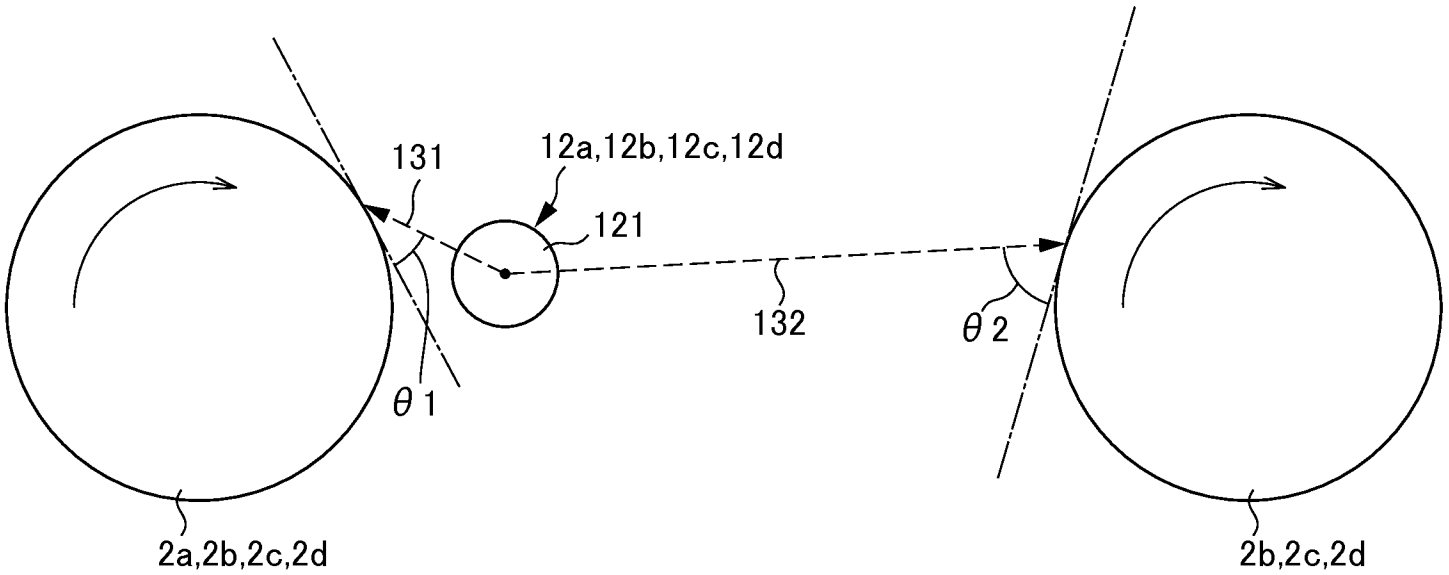
FIG. 7 is a diagram illustrating an emission direction of neutralization light toward photoreceptor drums 2*a*, 2*b* in the two image forming units 15*a*, 15*b* shown in FIG. 3.

In the above-described configuration, as shown in FIG. 7, the first reflective part 123 and the second reflective part 124 in the neutralization units 12*a*, 12*b*, 12*c*, and 12*d* are configured such that an angle θ1 at which the first neutralization light 131 is incident upon the surfaces of the corresponding photoreceptor drums 2*a*, 2*b*, 2*c*, and 2*d* is smaller than an angle θ2 at which the second neutralization light 132 is incident upon the surfaces of the corresponding photoreceptor drums 2*b*, 2*c*, and 2*d*.

Since the first neutralization light 131 for post-transfer neutralization has a relatively short optical path, the relatively small incident angle θ1 would not be a problem. On the other hand, since the second neutralization light 132 for pre-transfer neutralization has a relatively long optical path, the incident angle θ2 must be relatively great.

The incident angle θ1 of the first neutralization light 131 and the incident angle θ2 of the second neutralization light 132 are angles between: incident lines of the first neutralization light 131 and the second neutralization light 132; and tangents of the photoreceptor drums 2*a*, 2*b*, 2*c* and 2*d* passing through incident points of the first neutralization light 131 and the second neutralization light 132 (dashed-dotted line in FIG. 7), respectively.

Next, operation of the neutralization units 12*a*, 12*b*, 12*c* and 12*d* in the present embodiment is described. The neutralization light source 122 is turned on to introduce light from the first end face 121*a* of the substantially cylindrical light guiding body 121 in the longitudinal direction X1-X2, along the longitudinal direction of the light guiding body 121. The light thus introduced is reflected by the first reflective part 123 and the second reflective part 124, thereby forming the first neutralization light 131 and the second neutralization light 132.

The first neutralization light 131 irradiates regions on the photoreceptor drums 2*a*, 2*b*, 2*c* and 2*d* constituting the four image forming units 15*a*, 15*b*, 15*c*, and 15*d*, the regions spanning from positions facing the primary transfer positions to positions facing the cleaning units 11*a*, 11*b*, 11*c*, and 11*d*, respectively. The first neutralization light 131 thus neutralizes residual charge on the surface of the photoreceptor drums 2*a*, 2*b*, 2*c* and 2*d* after the primary transfer of a toner image to the intermediate transfer belt 7 (post-transfer neutralization).

As a result, generation of the exposure memory image due to a difference in surface potential, being lower than the peripheral potential, caused upon follow-up charging of the exposed part can be suppressed. In other words, a phenomenon in which a part in which the memory image is generated is printed darker than a periphery in a background part can be suppressed.

On the other hand, the second neutralization light 132 irradiates regions on the photoreceptor drums 2*b*, 2*c* and 2*d* constituting the four image forming units 15*a*, 15*b*, 15*c*, and 15*d*, the regions spanning from positions facing the developing units 16*b*, 16*c* and 16*d* to positions facing the primary transfer positions, respectively. The second neutralization light 132 thus neutralizes the electrical charge so that surface charge becomes uniform in regions in which toner images are formed on the photoreceptor drums 2*b*, 2*c* and 2*d* (pre-transfer neutralization).

As a result, generation of the transfer memory image due to a difference in surface potential upon follow-up charging, higher than the peripheral potential in non-printed regions, caused by residual toner that reduces a current value can be suppressed. In other words, a phenomenon in which a part in which the memory image is generated is printed lighter than a periphery in a background part can be suppressed.

As described above, in the present embodiment, by providing the neutralization units 12*a*, 12*b*, 12*c* and 12*d*, each composed of the elongated light guiding body 121 and the neutralization light source 122, in the four image forming units 15*a*, 15*b*, 15*c* and 15*d* respectively, first neutralization (post-transfer neutralization) for neutralizing the residual charge on the photoreceptor drums 2*a*, 2*b*, 2*c* and 2*d* after transfer of the toner image to the intermediate transfer belt 7 and second neutralization (pre-transfer neutralization) for reducing potential of entire peripheral surfaces of the photoreceptor drums 2*b*, 2*c* and 2*d* of the three image forming units 15*b*, 15*c* and 15*d* on the downstream side in the rotational direction R1 of the intermediate transfer belt 7 can be performed simultaneously. As a result, the residual charge on the photoreceptor drums 2*a*, 2*b*, 2*c* and 2*d* can be sufficiently neutralized to thereby sufficiently suppress generation of the transfer memory image and the exposure memory image.

The first embodiment provides the following effects, for example.

In the plurality of (four) image forming units 15*a*, 15*b*, 15*c* and 15*d* in the printer 1 of the first embodiment, the neutralization units 12*a*, 12*b*, 12*c* and 12*d* disposed between the primary transfer position and the cleaning units 11*a*, 11*b*, 11*c* and 11*d* in the rotational direction of the photoreceptor drums 2*a*, 2*b*, 2*c* and 2*d* irradiate the regions on the photoreceptor drums constituting the image forming units 15*a*, 15*b*, 15*c* and 15*d* with the first neutralization light 131, the regions spanning from positions facing the primary transfer positions to positions facing the cleaning units 11*a*, 11*b*, 11*c* and 11*d*. In addition, the neutralization units 12*b*, 12*c* and 12*d* irradiate regions on the photoreceptor drums 2*b*, 2*c* and 2*d* constituting the image forming units 15*b*, 15*c*, and 15*d* that are disposed adjacently on the downstream side in the rotational direction of the intermediate transfer belt 7 with the second neutralization light 132, the regions spanning from positions facing the developing units 16*b*, 16*c*, and 16*d* and to positions facing the primary transfer positions.

The first neutralization light 131 thus neutralizes residual charge on the surface of the photoreceptor drums 2*a*, 2*b*, 2*c* and 2*d* after the primary transfer of the toner image to the intermediate transfer belt 7. Generation of the exposure memory image can thus be suppressed. In addition, the second neutralization light 132 neutralizes the electrical charge so that surface charge becomes uniform in regions in which toner images are formed on the photoreceptor drums 2*b*, 2*c* and 2*d*, to thereby suppress generation of the transfer memory image. A phenomenon in which a part in which the memory image is generated is printed lighter or darker than a periphery in a background part can be suppressed.

In addition, in the printer 1 of the first embodiment, the neutralization units 12*a*, 12*b*, 12*c* and 12*d* are respectively provided with: the elongated light guiding body 121; the neutralization light source 122 that guides light into the light guiding body 121 in the longitudinal direction X1-X2, from the end face 121*a* thereof in the longitudinal direction; and the first reflective part 123 that reflects the light emitted from the neutralization light source 122 to the shorter direction Y1-Y2 to thereby form the first neutralization light 131 and the second reflective part 124 that reflects the light emitted from the neutralization light source 122 to the shorter direction Y1-Y2 to thereby form the second neutralization light 132, provided at different positions on a side face of the light guiding body 121 in the shorter direction Y1-Y2.

In such a configuration, both the first neutralization light 131 effective for suppression of generation of the exposure memory image and the second neutralization light 132 effective for suppression of generation of the transfer memory image can be formed by a single pair of the neutralization light source 122 and the light guiding body 121. The neutralization units 12*a*, 12*b*, 12*c* and 12*d* can thus be simplified in configuration, reduced in cost, and made more energy efficient.

In addition, the first neutralization light 131 and the second neutralization light 132 can be formed by introducing the light from the neutralization light source 122 to the elongated light guiding body 121 through the end face 121*a* thereof in the longitudinal direction X1-X2 and making the light reflect, without passing through a through opening or the like. The intensity of the first neutralization light 131 and the second neutralization light 132 can thus be stabilized and optimized. An effect of suppressing generation of the exposure memory image and the transfer memory image can thus be more readily realized.

In addition, in the printer 1 of the first embodiment, the first reflective part 123 and the second reflective part 124 are formed in serrated shapes with a plurality of concave grooves 125 and concave grooves 126 provided uniformly on side faces of the light guiding body 121. Given this, by changing the pitch P10 of the plurality of concave grooves 125 and the pitch P20 of the plurality of concave grooves 126 appropriately, the intensity of the first neutralization light 131 and the second neutralization light 132 can be easily and appropriately adjusted, thereby further improving the effect of suppressing generation of the exposure memory image and the transfer memory image.

Furthermore, in the printer 1 of the first embodiment, the pitch P10 of the plurality of concave grooves 125 on the first reflective part 123 is set to be smaller than pitch P20 of the plurality of concave grooves 126 on the second reflective part 124. As a result, the intensity of the first neutralization light 131 can be made greater than the intensity of the second neutralization light 132, to sufficiently suppress generation of the exposure memory image. In addition, since the intensity of the second neutralization light 132 is relatively low and does not peak locally, problems such as a color toner on a downstream side scattering from a photoreceptor drum upon multi-color transfer, and a slight vertical line generated on an image can be suppressed.

Second Embodiment

Next, a second embodiment of the present disclosure is described. The description of the second embodiment will focus on the points of difference from the first embodiment, and those aspects of configuration that are the same as the first embodiment are denoted with the same reference numerals, and detailed description thereof will be omitted. Description in relation to the first embodiment is suitably applied in relation to points that are not described in particular detail in relation to the second embodiment. In addition, the second embodiment provides the same effects as the first embodiment.

Figure 8:
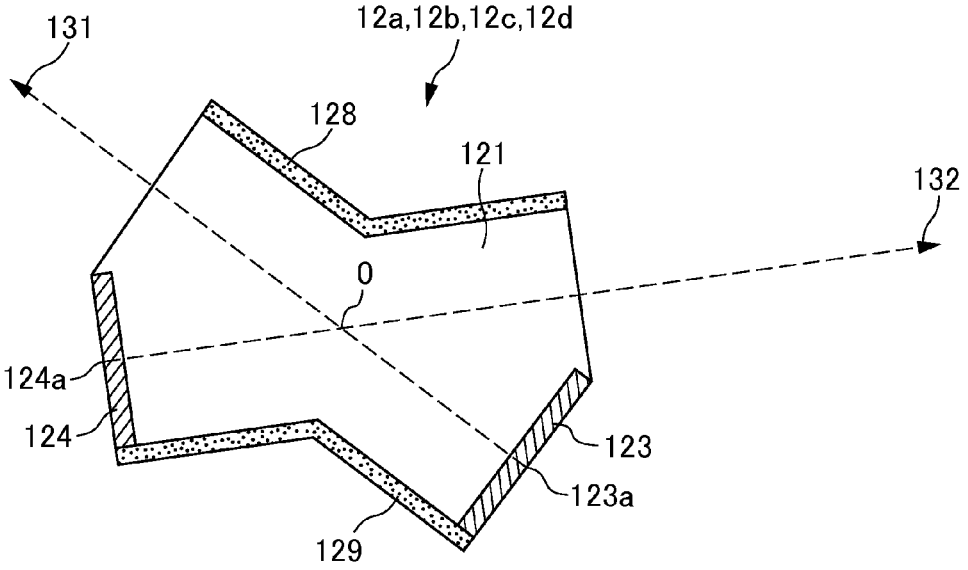
FIG. 8 is an enlarged vertical cross-sectional view of the light guiding body 121 constituting the neutralization units 12*a*, 12*b*, 12*c*, and 12*d* according to the second embodiment of the present disclosure.

The second embodiment is different from the first embodiment in a vertical cross-sectional shape of the light guiding bodies 121 in the neutralization units 12*a*, 12*b*, 12*c* and 12*d*. For the second embodiment, the difference is mainly described. FIG. 8 is an enlarged vertical cross-sectional view of the light guiding body 121 constituting the neutralization units 12*a*, 12*b*, 12*c*, 12*d* according to the second embodiment of the present disclosure.

As shown in FIG. 8, the light guiding body 121 of the second embodiment is an elongated light guiding body having an irregular octagonal shape. The irregular octagonal shape of a vertical cross-section is a shape in which an apex formed by two adjacent faces is close to an apex formed by two adjacent faces on an opposite side; and an apex formed by other two adjacent faces is spaced apart from an apex formed by two adjacent faces on an opposite side.

Among eight faces of the abovementioned elongated light guiding body 121 in the irregular octagonal shape, one of the two adjacent faces forming the apex spaced apart from an opposing apex has the serrated first reflective part 123, and opposite one of the two adjacent faces forming the apex has the serrated second reflective part 124, along an entire length of the light guiding body 121 in the longitudinal direction X1-X2.

As in the first embodiment, central positions 123*a* and 124*a* of widths in the peripheral direction of the light guiding body 121 at the first reflective part 123 and the second reflective part 124, respectively, are in a positional relationship except for 180° in the peripheral direction of the light guiding body 121.

The first reflective part 123 reflects the light emitted from the neutralization light source 122 to the shorter direction, in other words peripherally outward from a center O of the light guiding body 121, thereby forming the first neutralization light 131. The second reflective part 124 reflects the light emitted from the neutralization light source 122 to the shorter direction, in other words peripherally outward, differently from the first neutralization light 131, from the center O of the light guiding body 121, thereby forming the second neutralization light 132.

Among eight faces of the abovementioned elongated light guiding body 121 in the irregular octagonal shape, the two adjacent faces forming the apex approaching an opposing apex and the two adjacent faces on an opposite side are coated with reflective layers 128 and 129, respectively. The reflective layers 128, 129 allows appropriate adjustment of intensity of the first neutralization light 131 and the second neutralization light 132 by choosing thickness of the layers, a coating agent, and the like.

With the light guiding body 121 of the second embodiment, diffusion of the first neutralization light 131 and the second neutralization light 132, and generation of flare can be suppressed.

A preferred embodiment of the present disclosure has been described above; however, the present disclosure is not limited thereto and can be carried out in various modes.

For example, in the above embodiments, the light guiding body 121 of the substantially cylindrical shape or the irregular octagonal shape has been described; however, the present disclosure is not limited thereto. As long as the positional relationship between the first reflective part 123 and the second reflective part 124 can be in an angle other than 180° in the peripheral direction of the light guiding body 121, the light guiding body having a cross-section of a substantially regular hexagonal shape or a substantially regular octagonal shape can be used.

The image forming apparatus of the present disclosure is not particularly limited, and can be, in addition to a printer, a color copy machine, a facsimile machine, and a multi-functional printer having functions thereof.

The invention claimed is:

1. An image forming apparatus comprising: a circular transfer belt that rotates in a predetermined direction; and a plurality of image forming units arranged at intervals in a rotational direction of the transfer belt, wherein each of the plurality of image forming units includes:

an image supporting body arranged to face a primary transfer position on an outer face of the transfer belt and configured to be rotatable;

a charging unit that electrically charges the image supporting body;

an exposing unit that forms an electrostatic latent image on the image supporting body;

a developing unit that develops the electrostatic latent image formed by the exposing unit with a toner to thereby form a toner image;

a neutralizing unit that neutralizes electric charge on the image supporting body by irradiating the image supporting body with light; and a cleaning unit that cleans residual toner remaining on the image supporting body, wherein, in at least one of the plurality of image forming units, the neutralizing unit is configured to:

be arranged between the primary transfer position and the cleaning unit in a rotational direction of the image supporting body;

irradiate a first neutralization light onto a region on the image supporting body constituting the image forming unit, the region spanning from a position facing the primary transfer position to a position facing the cleaning unit; and irradiate a second neutralization light onto a region on the image supporting body constituting an image forming unit arranged adjacently to the image forming unit on a downstream side thereof in the rotational direction of the transfer belt, the region spanning from a position facing the developing unit to a position facing the primary transfer position, and the neutralizing unit includes:

an elongated light guiding body having a longitudinal direction and a shorter direction that is orthogonal to the longitudinal direction and having a cross-sectional shape of an irregular octagon;

a neutralization light source that guides light into the light guiding body in the longitudinal direction, from an end face thereof in the longitudinal direction; and a first reflective part and a second reflective part provided at different side faces of the light guiding body, wherein an apex of a first adjacent pair of sides and an apex of a second adjacent pair of sides respectively project toward a center of the irregular octagon in a cross-sectional view, and the first reflective part is located corresponding to a side that orthogonally joins a first side of the first adjacent pair of sides and the second reflective part is located corresponding to a side that orthogonally joins a second side of the first adjacent pair of sides, wherein the first side of the first adjacent lair of sides is configured to be parallel with a first side of the second adjacent pair of sides and the second side of the first adjacent pair of sides is configured to be parallel with a second side of the second adjacent pair of sides, wherein an end of the first reflective part is disposed on an extension line of the first side of the second adjacent pair of sides and an end of the second reflective part is disposed on an extension line of the second side of the second adjacent pair of sides, wherein side faces of the light guiding body located corresponding to the first adjacent pair of sides and side faces of the light guiding body located corresponding to the second adjacent pair of sides are each coated with a reflective layer, and the remaining side faces except for the side faces coated with the reflective layer and the side faces at which the first reflective part and the second reflective part are located are configured to be optically permeable, wherein the first reflective part forms the first neutralization light by reflecting the light from the neutralization light source to the shorter direction and the second reflective part forms the second neutralization light by reflecting the light from the neutralization light source to the shorter direction, wherein the first neutralization light reaches a surface of the image supporting body corresponding thereto without a change caused by other structural elements in a course in which the first neutralization light travels, and the second neutralization light reaches a surface of the image supporting body corresponding thereto without a change caused by other structural elements in a course in which the second neutralization light travels, wherein the first reflective part and the second reflective part are positioned such that an angle at which the first neutralization light is incident upon the surface of the image supporting body corresponding thereto is smaller than an angle at which the second neutralization light is incident upon the surface of the image supporting body corresponding thereto, wherein an intensity of the first neutralization light is greater than an intensity of the second neutralization light, and wherein the elongated light guiding body having a cross-sectional shape of an irregular octagon is configured to be symmetric with respect to a line which passes through an intersection between a ray of the first neutralization light and a ray of the second neutralization light and bisects an angle therebetween, the ray of the first neutralization light being reflected off a center of the first reflective part in the shorter direction and the ray of the second neutralization light being reflected off a center of the second reflective part in the shorter direction, when viewed in a cross section.

2. The image forming apparatus according to claim 1, wherein the first reflective part and the second reflective part are formed in a serrated shape with a plurality of concave grooves arranged uniformly in the longitudinal direction on a side face of the light guiding body.

3. The image forming apparatus according to claim 2, wherein pitch of the plurality of concave grooves on the serrated first reflective part is set to be smaller than pitch of the plurality of concave grooves on the serrated second reflective part.

4. The image forming apparatus according to claim 1, wherein central positions of the first reflective part and the second reflective part are in a positional relationship with each other except for 180° with respect to the center of the irregular octagon such that the first neutralization light is not incident upon the second reflective part and the second neutralization light is not incident upon the first reflective part.

5. The image forming apparatus according to claim 2, wherein central positions of the first reflective part and the second reflective part are in a positional relationship with each other except for 180° with respect to the center of the irregular octagon such that the first neutralization light is not incident upon the second reflective part and the second neutralization light is not incident upon the first reflective part.

6. The image forming apparatus according to claim 3, wherein central positions of the first reflective part and the second reflective part are in a positional relationship with each other except for 180° with respect to the center of the irregular octagon such that the first neutralization light is not incident upon the second reflective part and the second neutralization light is not incident upon the first reflective part.

7. The image forming apparatus according to claim 1 further comprising a belt cleaning unit for removing a residual toner remaining on the transfer belt that is disposed on an outer face of the transfer belt so as to face an upstream side of the plurality of image forming units in the rotational direction of the transfer belt, wherein the second neutralization light is not incident upon the image supporting body constituting the image forming unit disposed on the most upstream side in the rotational direction of the transfer belt among the plurality of image forming units.

8. The image forming apparatus according to claim 4, wherein the relationship with respect to the central positions of the first reflective part and the second reflective part includes an angular range of 120 to 150 degrees.

9. The image forming apparatus according to claim 5, wherein the relationship with respect to the central positions of the first reflective part and the second reflective part includes an angular range of 120 to 150 degrees.

10. The image forming apparatus according to claim 6, wherein the relationship with respect to the central positions of the first reflective part and the second reflective part includes an angular range of 120 to 150 degrees.

* * * * *